US005327834A

United States Patent [19]

Atkeson

[11] Patent Number: 5,327,834

[45] Date of Patent: Jul. 12, 1994

[54] INTEGRATED FIELD-EFFECT INITIATOR

[75] Inventor: Peter L. C. Atkeson, Elkton, Md.

[73] Assignee: Thiokol Corporation, Ogden, Utah

[21] Appl. No.: 889,427

[22] Filed: May 28, 1992

[51] Int. Cl.[5] ..... F42C 19/12

[52] U.S. Cl. ..... 102/202.9; 102/202.1; 102/202.8; 257/195

[58] Field of Search ..... 102/202.8, 202.2, 202.9, 102/202.7, 202.14, 202.5, 202.1; 257/195

[56] References Cited

U.S. PATENT DOCUMENTS

| | | | |
|---|---|---|---|
| 3,211,096 | 10/1965 | Forney et al. . | |
| 3,292,537 | 12/1966 | Goss, Jr. . | |
| 3,366,055 | 1/1968 | Hollander, Jr. . | |
| 3,882,324 | 5/1975 | Smolker et al. | 307/202 A |
| 4,425,572 | 1/1984 | Takafuji et al. | 357/4 |
| 4,514,253 | 4/1985 | Minezaki | 156/659.1 |
| 4,708,060 | 11/1987 | Bickes, Jr. et al. | 102/202.7 |
| 4,840,122 | 6/1989 | Nerheim | 102/202.7 |
| 5,085,146 | 2/1992 | Baginski | 102/202.5 |
| 5,179,248 | 1/1993 | Hartman et al. | 102/202.1 |

FOREIGN PATENT DOCUMENTS

| | | | |
|---|---|---|---|
| 3537820 | 4/1987 | Fed. Rep. of Germany | 102/202.5 |
| 816530 | 7/1959 | United Kingdom | 102/202.8 |

*Primary Examiner*—Stephen M. Johnson

*Attorney, Agent, or Firm*—Cushman, Darby and Cushman

[57] ABSTRACT

An integrated field-effect initiator useful for the pyrotechnic initiation or detonation of explosives includes a semiconductor channel of a first conductivity type bounded on opposite ends by semiconductor material of an opposite conductivity type to define two PN junctions in the conduction path. The semiconductor channel is doped to define a conduction path of sufficiently high impedance to prevent unintended initiation. A gate electrode is positioned adjacent the channel and separated therefrom by an insulation layer to affect the conductivity of the channel as a function of a potential applied to the gate. In normal operation, an initiation electrical potential is applied to the opposite ends of the conduction path and a gate potential is applied to the gate to effect field-enhanced conduction in the path sufficient to allow vaporization of the path to cause initiation of an explosive material in contact with the path. In another embodiment, a slapper structure is mounted adjacent the channel and is propelled into the explosive to effect detonation. The initiator can be manufactured by conventional integrated circuit fabrication techniques and provides a normally inhibited device that requires application of a gate potential prior to initiation.

20 Claims, 2 Drawing Sheets

INTEGRATED FIELD-EFFECT INITIATOR

BACKGROUND OF THE INVENTION

The present invention relates to an integrated field-effect initiator for initiating explosives and, more particularly, to an initiator useful for the ignition or detonation of explosive materials, pyrotechnic materials, propellants, gas generation materials, and the like.

Various devices have been developed for the purpose of initiating explosives; these devices have included exploding conductive wires and foils, spark gaps, and various semiconductor materials. In general, electrical energy is applied to the device and flows through a conductive pathway to generate heat energy that is transferred to a surrounding "first-fire" explosive material. The conductive pathway can be heated to incandescence or vaporized to generate a conductive plasma. In other types of devices, a projectile, known as a "slapper," is positioned immediately adjacent the conductive pathway. The electrical energy conducted through the pathway causes a violent vaporization of the conductive material. Sufficient kinetic energy is transferred to the slapper to ballistically propel the slapper into the "first-fire" material to cause shock waves that start the detonation process.

Historically, a number of disadvantages have been associated with initiators that use a two-terminal, conductive pathway. For example, conductive bridge wires have been susceptible to inadvertent operation from nearby lightening strikes, stray electrical fields from nearby electrical machinery, static electricity, and radio frequency energy from nearby radio transmitters. Semiconductor bridges have been designed to minimize inadvertent discharge and typically include a semiconductor material doped with a selected material to provide desired conduction characteristics, including, for example, a negative temperature coefficient, that provide a measure of immunity from unintended initiation.

Regardless of the type of conductive pathway used, i.e., wires, foils, and semiconductors, initiators are subject to no-fire tests in which the integrity of an initiator is tested by passing an electric current through the conduction pathway at a voltage less than the all-fire value. A typical no-fire test can pass a 500 volt no-fire signal through the initiator in contrast to a 2000 volt all-fire signal. One disadvantage associated with no-fire testing is the heat generated by the conductive pathway as a consequence of the applied no-fire test voltage. The heat, while less than that necessary to effect initiation, is oftentimes sufficient to cause thermal degradation of the "first-fire" material immediately adjacent the conductive pathway. This degradation, which is not easily detectable, can cause a malfunction when the all-fire signal is subsequently applied.

SUMMARY OF THE INVENTION

In view of the above, it is an object of the present invention, among others, to provide an integrated field-effect initiator in the form of a three-terminal device that requires an enable signal in addition to the usual initiation current to fire.

It is another object of the present invention to provide an integrated field-effect initiator in which the accidental application of a voltage to a device will not cause inadvertent initiation in the absence of the enable signal.

It is still another object of the present invention to provide an integrated field-effect initiator in which a no-fire test current can be applied to the device to test its operational integrity without causing heat sufficient to adversely affect the adjacent first-fire material.

The present invention provides an integrated field-effect initiator having a substrate upon which a conductive gate structure is formed and over which an insulator layer is deposited. A semiconductor material is deposited over the insulated gate and includes a semiconductor bridge of a first conductivity type immediately over the gate region and regions of a second conductivity type on opposite ends of the bridge to define two back-to-back PN junctions and corresponding depletions regions within the opposite end portions of the bridge. The conductivity of the bridge is normally low and presents an impedance sufficiently high to prevent inadvertent operation of the initiator. When an appropriate potential is applied to the gate, the corresponding field-effect forms an enhanced conduction channel between the PN junctions that responds to the all-fire signal.

In the preferred embodiment, the initiator is formed by semiconductor fabrication techniques on a sapphire substrate upon which a conductive polysilicon or metal is deposited to form the gate structure. Thereafter a silicon dioxide insulating layer is formed over a portion of the gate structure. A semiconductor bridge region is formed over the silicon dioxide layer immediately above the insulating layer in the region of the gate structure and is doped with an n-type dopant, such as phosphorus or antimony. The regions immediately adjacent the ends of the n-region are doped with a p-type impurity, such as boron or aluminum, to form $p^+$ source and drain regions at opposite ends of the n-type bridge region. Aluminum contact pads are deposited over the $p^+$ source and drain regions and over the uninsulated portion of the gate structure. The die is bonded or otherwise mounted on a three-pin header that includes a body through which first, second, and third wires extend to define terminals. Bonding wires establish the electrical connections between the terminals and their respective contact pads. Thereafter, a first-fire material is formed contiguous the initiator and a cap or other closure mounted over the header.

The various semiconductor regions define back-to-back PN junctions, preferably with a substantial reverse bias. The integrity of the channel path can be verified by a suitable no-fire test voltage without generation of heat sufficient to effect deterioration of the surrounding first-fire material. In order to fire the initiator, a potential is applied to the gate with the resultant field forming an enhanced conduction channel through the semiconductor bridge so that the all-fire signal will cause vaporization.

In another form of the invention, a silicon nitride layer is deposited immediately above the channel and is ballistically propelled into the first-fire material to cause detonation.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
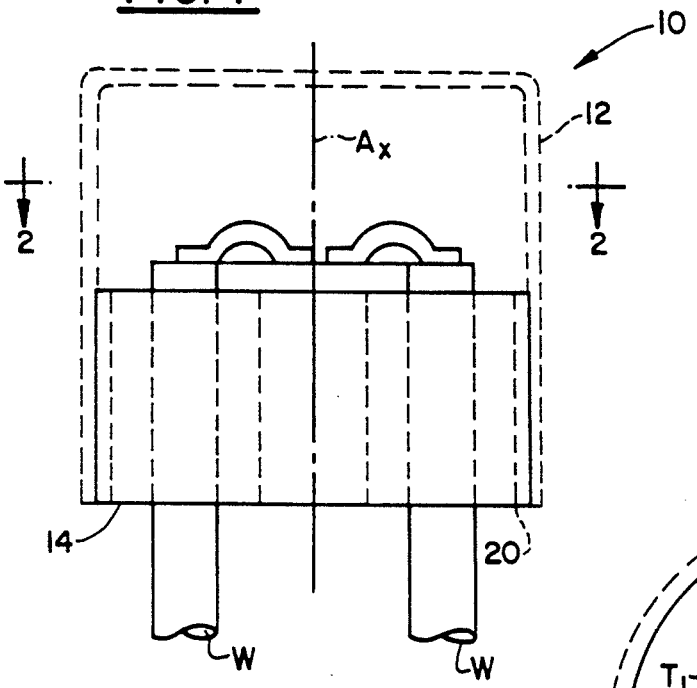
FIG. 1 is a side elevational view, in cross-section, of an integrated field-effect initiator in accordance with the present invention.
Figure 2:
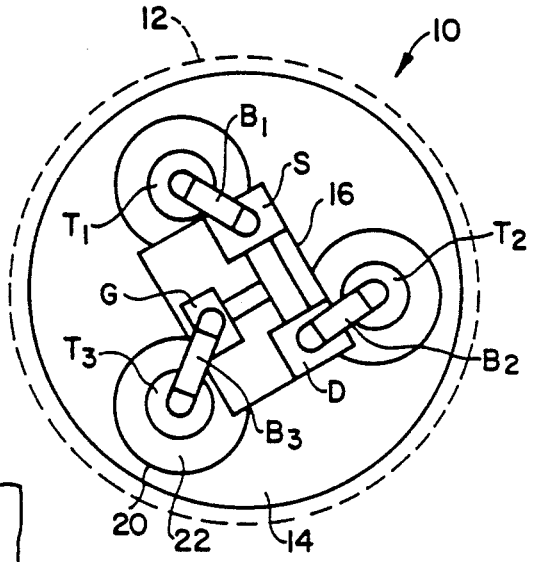
FIG. 2 is a cross-sectional plan view taken along line 2—2 of FIG. 1 of the initiator and illustrates a semiconductor die in the central region thereof.

An integrated field-effect initiator in accordance with the present invention is shown in cross-section in FIGS. 1 and 2 and designated generally therein by the reference character 10. As shown, the initiator 10 is defined about a longitudinal axis $A_x$ and includes a tubular barrel 12 (dotted-line illustration) mounted upon cylindrical header 14. An initiator die 16 is mounted atop the header 14 and, as explained below, initiates a first-fire material 18 (not specifically shown) contained within the barrel 12. Three conductive wires W (only two of which are shown in FIG. 1) extend through and from the header 14 for connection to an appropriate control device (not shown) that can selectively apply the no-fire test signal or the all-fire signal. The illustrated tubular barrel 12 is exemplary only and, as can be appreciated by those skilled in the art, various mounting flanges, tabs, and exterior threads can be provided in accordance with the specific design requirements for the intended application of the initiator 10.

As shown in FIG. 2, the wires W extend through appropriately oversized bores (indicated generally at 20) and terminate a selected distance above the interior surface of the header 14 to define terminal posts $T_1$, $T_2$, and $T_3$ as described more fully below. A seal, generally indicated at 22, surrounds each wire W and forms a structural and hermetic seal with the header 14. Where the header 14 is formed from a metal, the seal 22 is designed to provide a hermetic seal between the wires W and the header material, the seal 22 compensating for any difference in the thermal coefficient of expansion between the two materials. The barrel 12 extends upwardly from the header 14 and includes a closed end (unnumbered) that defines the axial extent of the interior volume that is filled with the first-fire material. In the case where the initiator is intended for use as a gas generator in an air-bag application, a known nitrogen gas generating material, such as sodium azide, is provided in the interior volume defined by the barrel 12.

As shown in FIG. 2, the initiator die 16 is generally rectangular and mounted on the header surface between the various terminal posts defined by the ends of the connections wires W. The initiator die 16 includes three bonding pads that are connected to the terminal posts. More specifically, a source bonding pad S is connected to the terminal post $T_1$ by a bonding wire $B_1$, a drain bonding pad D is connected to the terminal post $T_2$by a bonding wire $B_2$, and a gate bonding pad G is connected to the terminal post $T_3$ by a bonding wire $B_3$. The bonding wires are typically aluminum and are mechanically and electrically connected between their respective terminal posts and bonding pads by, for example, resistance, laser, optical, or thermocompression welding. As will be appreciated by those skilled in the art, the designation of a source bonding pad S and a drain bonding pad D is arbitrary, since the source and drain functions are interchangeable.

Figure 5:
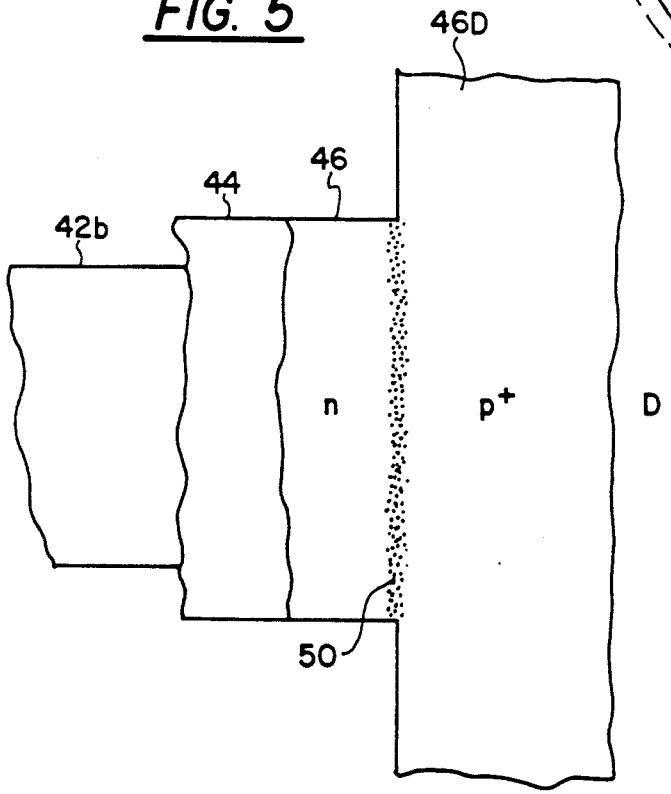
FIG. 5 is a partial plan view of a portion of the semiconductor die with selected layers removed to reveal underlying structure.
Figure 3:
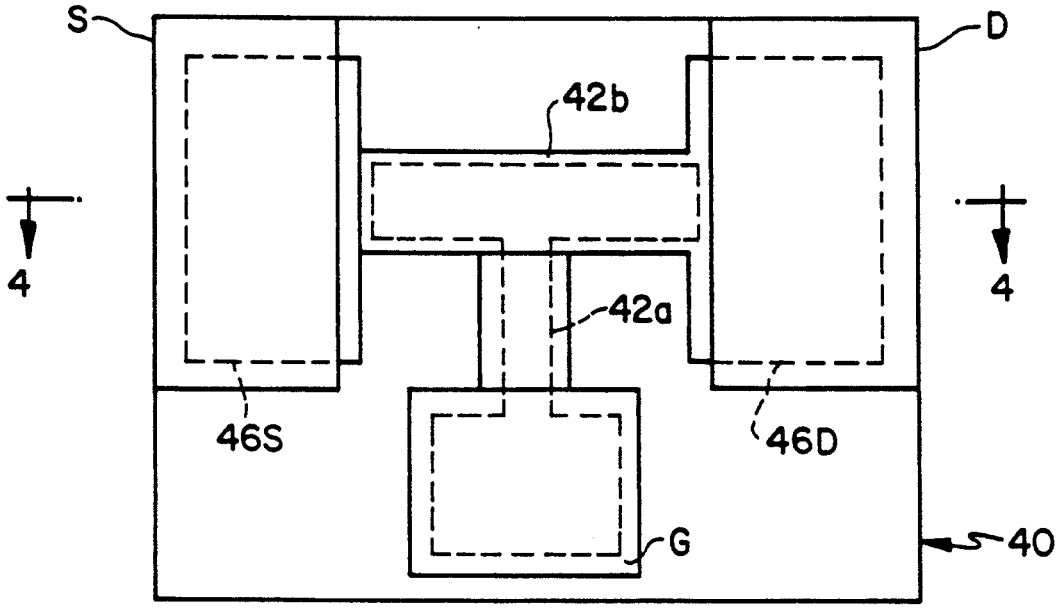
FIG. 3 is an enlarged plan view of the semiconductor die of FIG. 2.
Figure 4:
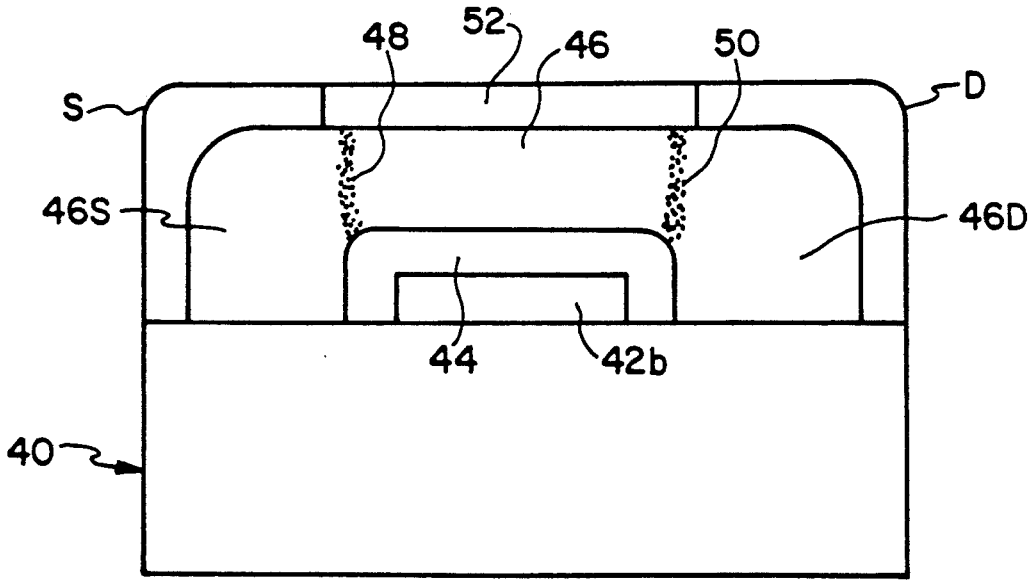
FIG. 4 is a cross-section view of the die of FIG. 3 taken along line 3—3 thereof.

The initiator die 16, as shown in FIGS. 3, 4, and 5, includes an insulating substrate 40 upon which the various semiconductor, insulator, and metal layers or features are formed using conventional semiconductor fabrication techniques. As shown, an electrically conductive T-shaped gate formation 42 (dotted-line illustration in FIG. 3) is deposited or otherwise formed on the upper surface of the substrate 40 and includes a descender portion 42*a* and an orthogonally aligned cross-piece 42*b*. The descender portion 42*a* is positioned at an intermediate location along the cross-piece 42*b*. The electrically conductive gate bonding pad G is formed over the remote end of the descender portion 42*a*, and an electrically insulating layer 44 is formed over the remaining area of the gate formation 42 (i.e., the remaining portions of the decender portion 42*a* and the cross-piece 42*b*). The electrically insulating layer 44 overlies and insulates the various side surfaces of the gate formation 42, except for the portion thereof upon which the gate bonding pad G is formed at the distal end of the decender portion 42*a*. As shown in the cross-sectional view of FIG. 4, a semiconductor bridge, generally indicated at 46, is formed over the insulating layer 44 immediately above the cross-piece 42*b* of the gate formation. As shown in FIGS. 4 and 5, the semiconductor bridge 46 extends beyond the distal ends of the insulating layer 44 to define a source region 46S and a drain region 46D at the opposite end portions thereof. The source bonding pad S is formed upon the source region 46S, and the drain bonding pad D is formed upon the drain region 46D of the semiconductor bridge 46.

In the preferred embodiment, the substrate 40 typically has a side dimension of about 2.54 mm (0.1 inch) and is sapphire with the various semiconductor, insulator, and metal layers formed on the sapphire surface, as explained below, to form a semiconductor-on-sapphire (S.O.S) device. The sapphire substrate 40 is formed with a smoothly finished and optically polished surface upon which the subsequent materials are deposited.

The gate formation 42 is preferably aluminum or a conductive polysilicon and can be formed by one of several conventional techniques. For example, a T-shaped aluminum gate can be formed by metalizing the entire surface of the sapphire substrate 40 by sputtering or evaporative deposition. A photoresist is applied over the area of the aluminum layer corresponding to the gate formation 42 and then cured. The aluminum beyond the photoresist is chemically removed by the use of an aluminum-specific etchant, and the cured photoresist then removed to expose the gate formation 42. As shown in FIG. 3, the remote end of the descender 42*a* can be enlarged somewhat to accommodate the gate bonding pad G.

After the gate formation 42 is created, a silicon dioxide ($SiO_2$) insulation layer 44 is formed over the entire exposed surface of the gate formation 42 except for that area at the remote end of the descender 42*a* that is to receive the gate bonding pad G. The insulation layer 44 can be formed by first masking all surfaces that are not to receive the silicon dioxide layer, including that area at the remote end of the descender 42*a* that is to receive the gate bonding pad G. The silicon dioxide is then deposited, for example, by conventional deposition of a silicon layer that is subsequently oxidized in either a wet or dry oxidizing environment to form an insulating silicon dioxide layer.

The semiconductor bridge 46 is grown, for example, epitaxially, over that area of the insulation layer 44 corresponding to the cross-piece 42*b* and extends beyond the ends of the insulating layer 44 as shown in FIG. 4. During formation of the semiconductor bridge 46, dopant atoms are introduced to provide the desired conduction characteristics. More specifically, a p-type dopant, such as boron or aluminum, is introduced into the opposite ends regions of the semiconductor bridge 46 to define a $p^+$ region at the left and right ends of the semiconductor bridge 46. The $p^+$ regions are preferably heavily doped, i.e , $10^{18}$ atoms/$cm^3$. That portion of the semiconductor bridge extending between the two $p^+$ regions is doped with a opposite type dopant, i.e., an n-type dopant, such phosphorus or antimony, to provide an n-type channel region between the $p^+$ regions and thus define two PN junctions, 48 and 50, one adjacent each end of the semiconductor bridge 46. In FIGS. 4 and 5, the PN junctions are represented in an idealized fashion by the stippled regions. Respective depletion regions (not illustrated) will exist in the p-type and n-type materials on the opposite sides of the two PN junctions; the extent of the depletion regions dependent upon the local doping concentration. As can be appreciated, the organization of the p- and n-type materials is such the two PN junctions 48 and 50 exist in a two-diode, back-to-back electrical circuit relationship.

After the semiconductor bridge 46 is formed, aluminum is deposited over the $p^+$ regions at the opposite ends of the semiconductor bridge 46 to create the source bonding pad S and the drain bonding pad D and, in a similar manner, aluminum is deposited at remote end of the descender portion 42*a* to form the gate bonding pad Aluminum is preferred as the bonding pad material since it has good conduction characteristics, adheres well to silicon, and, as a p-type impurity, is not inimical to the acceptor impurity used to form the $p^+$ regions.

As shown in FIG. 4, a silicon nitride ($Si_3N_4$) layer 52 is optionally formed at least over the semiconductor bridge 46 and may be deposited, as is conventional, by LPCVD using dichloralsilane ($S_1Cl_2H_2$) and ammonia ($NH_3$) at a temperature of between 700° C. and 800° C. Silicon nitride has a very high tensile strength and, in this context, the layer 52 can function as a "slapper" or flying plate for the detonation of high explosive.

As can be appreciated from the above, the gate terminal $T_3$ functions as a control for majority carrier conduction in that portion of the semiconductor bridge 46 extending between the $p^+$ regions. In the absence of a gate terminal $T_3$ voltage, the existence of the depletion regions will inhibit current flow. For example, application of a positive potential at a respective one of the drain or source bonding pads D or S relative to corresponding other source or drain bonding pad S or D will back bias one of the PN junctions and inhibit current. As can be appreciated, appropriate doping concentrations can provide reverse blocking voltages of as high as 500 volts.

In normal operation, a positive voltage is applied to the gate terminal $T_3$ so that the gate is positive with respect to the $p^+$ region under the source bonding pad S. The presence of the field will cause the presence of a p-region above the silicon dioxide insulating layer 44 that extends between the $p^+$ regions at the opposite ends of the semiconductor bridge 46. The effect of this p-region is to partially remove the depletion regions adjacent the PN junctions and form a continuous p-region pathway from the source bonding pad S to the drain bonding pad D. When a sufficient current (i.e., the all-fire current) is applied between the source bonding pad S and the drain bonding pad D while the aforementioned gate potential is applied, the p-region will heat until a conductive plasma is formed of ionized silicon and dopant. Where no silicon nitride layer 52 is provided, the hot plasma can cause initiation of the first-fire pyrotechnic material adjacent the initiator die 16, and, where a silicon nitride layer 52 is provided, the silicon nitride layer 52 can detonate the adjacent first-fire material.

The present invention is believed especially useful in direct initiation of insensitive pyrotechnic 25 materials, such as titanium hydride/potassium perchloride mixtures (THKP—$TiH_2KCl_4$).

In order to effect a no-fire integrity test, the no-fire test signal is impressed between the source and drain contact pads, S and D, without application of any gate potential to the gate contact pad G. In the absence of an conduction-enhancing field from the gate, the channel will have an impedance sufficiently high to minimize heat generation. Any heat generated will be less than that necessary to cause material degradation of the surrounding first-fire material. The gate formation, accordingly, functions in a manner analogous to a safety device.

The present invention advantageously provides an integrated field-effect initiator in which the conductivity of the conduction path is insufficient to effect operation in the absence of an appropriate gate control voltage and in which the equivalent of a flying plate or slapper can be formed by integrated semiconductor techniques.

As will be apparent to those skilled in the art, various changes and modifications may be made to the illustrated integrated field-effect initiator of the present invention without departing from the spirit and scope of the invention as determined in the appended claims and their legal equivalent.

What is claimed is:

1. A semiconductor initiator comprising, a semiconductor bridge extending between first and second electrical inputs, said bridge having an intermediate region thereof of a first conductivity type and regions at opposite ends of said intermediate region and of opposite conductivity type to define at least first and second PN junctions in said bridge between said first and second electrical inputs; and a field electrode adjacent to at least said intermediate region and insulated therefrom for providing a electric field in response to a selectively applied voltage sufficient for enhancing the conductivity of said intermediate region wherein said first conductivity type is n-type and said opposite conductivity type of said regions at the opposite ends of said intermediate region is p-type doped with a p-type dopant at a concentration of about $10^{18}$ atoms/$cm^3$.

2. The semiconductor initiator of claim 1, wherein said p-type dopant is boron or aluminum.

3. The semiconductor initiator of claim 1, further comprising a layer of a high-tensile strength material over at least said intermediate region of said semiconductor bridge to define a slapper plate.

4. The semiconductor initiator of claim 1, further comprising a layer of a silicon nitride material over at least said intermediate region of said semiconductor bridge to define a slapper plate.

5. A semiconductor initiator comprising, a conductive gate formed upon an insulating substrate;

an electrical insulator formed over said conductive gate;

a semiconductor bridge formed over said insulator in the region of said conductive gate and having an intermediate region thereof of a first conductivity type and regions at opposite ends of said intermediate region of opposite conductivity type to define at least first and second PN junctions in the bridge;

means for effecting electrical contact with said conductive gate and the opposite conductivity type regions, whereby application of an electrical potential to said conductive gate enhances the conductivity of said bridge through at least said first and second PN junctions therein.

6. The semiconductor initiator of claim 5, wherein said substrate is sapphire.

7. The semiconductor initiator of claim 5, wherein the first conductivity type is n-type.

8. The semiconductor initiator of claim 7, wherein the second conductivity type of said regions at the opposite ends of said intermediate region is p-type.

9. The semiconductor initiator of claim 7, wherein the said p-type regions are heavily doped with a p-type dopant.

10. The semiconductor initiator of claim 7, wherein the said p-type regions are doped with a boron or aluminum p-type dopant at a concentration of about $10^{18}$ atoms/$cm^3$.

11. The semiconductor initiator of claim 5, further comprising a layer of a high-tensile strength material over at least said intermediate region of said semiconductor bridge to define a slapper plate.

12. The semiconductor initiator of claim 5, further comprising a layer of a silicon nitride material over at least said intermediate region of said semiconductor bridge to define a slapper plate.

13. A semiconductor bridge initiator, comprising, a header having at least first, second, and third input conductors and a containment mounted thereto defining an interior volume for a first-fire material;

an initiator die substrate secured to said header and having first, second, and third electrical contacts connected to said first, second, and third input conductors;

said initiator die having a conductive gate formed upon a surface thereof;

an electrical insulator formed over said conductive gate; and a semiconductor bridge formed over said insulator in a region adjacent to said conductive gate and having a medial region thereof of a first conductivity type and regions at opposite ends of said medial region of opposite conductivity type to define at least first and second PN junctions in the region of the conductive bridge.

14. The semiconductor bridge initiator of claim 13, wherein said substrate is sapphire.

15. The semiconductor bridge initiator of claim 13, wherein the first conductivity type is n-type.

16. The semiconductor bridge initiator of claim 15, wherein the opposite conductivity type of said regions at the opposite ends of said medial region is p-type.

17. The semiconductor bridge initiator of claim 16, wherein the said p-type regions are heavily doped with a p-type dopant.

18. The semiconductor bridge initiator of claim 17, wherein the said p-type regions are doped with a boron or aluminum p-type dopant at a concentration of about $10^{18}$ atoms/$cm^3$.

19. The semiconductor bridge initiator of claim 13, further comprising a layer of a high-tensile strength material over at least said medial region of said semiconductor bridge to define a slapper plate.

20. The semiconductor bridge initiator of claim 13, further comprising a layer of a silicon nitride material over at least said medial region of said semiconductor bridge to define a slapper plate.

* * * * *